US008449968B2

(12) United States Patent
Mueller et al.

(10) Patent No.: US 8,449,968 B2
(45) Date of Patent: May 28, 2013

(54) CELLULAR CUSHIONING ARTICLE

(75) Inventors: Gerald E. Mueller, Eagan, MN (US); John W. Frank, Cottage Grove, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 63 days.

(21) Appl. No.: 13/153,576

(22) Filed: Jun. 6, 2011

(65) Prior Publication Data

US 2011/0318522 A1 Dec. 29, 2011

Related U.S. Application Data

(60) Provisional application No. 61/358,630, filed on Jun. 25, 2010.

(51) Int. Cl.
*B32B 1/00* (2006.01)
*B32B 3/12* (2006.01)

(52) U.S. Cl.
USPC ..... 428/178; 428/192; 428/43

(58) Field of Classification Search
USPC ..... 428/43, 178, 166, 192; 493/967; 206/522, 206/814
See application file for complete search history.

(56) References Cited

U.S. PATENT DOCUMENTS

| | | | | |
|---|---|---|---|---|
| 3,746,605 | A | 7/1973 | Dillon et al. | |
| 4,950,354 | A | 8/1990 | Schirmer | |
| 7,083,845 | B2 | 8/2006 | Graff | |
| 7,255,910 | B1 * | 8/2007 | Seckel | 428/174 |
| 2006/0210773 | A1 * | 9/2006 | Kannankeril | 428/166 |
| 2009/0017261 | A1 | 1/2009 | Hurley, Jr. et al. | |

FOREIGN PATENT DOCUMENTS

| | | |
|---|---|---|
| JP | 2000-128246 | 5/2000 |

* cited by examiner

*Primary Examiner* — Catherine A Simone
(74) *Attorney, Agent, or Firm* — Kevin W. Weber

(57) ABSTRACT

A cellular cushioning article is described. The cellular cushioning article may be used to wrap items such as fragile items needing protection during storage or shipping. The article includes a polymeric film including discrete first cells projecting from a major surface of the film. The first cells are arranged in rows parallel to each other, such that for two opposing polymeric films with the major surfaces facing each other, the total thickness of the two opposing polymeric films is less than twice the thickness of one polymeric film. The cellular cushioning article can be fan-folded into a stack occupying much less volume as compared to stacks formed by fan-folding known cellular cushioning articles.

16 Claims, 8 Drawing Sheets

CELLULAR CUSHIONING ARTICLE

CROSS REFERENCE TO RELATED APPLICATION

This application claims the benefit of U.S. Provisional Patent Application No. 61/358,630, filed Jun. 25, 2010, the disclosure of which is incorporated by reference herein in its entirety.

FIELD OF THE INVENTION

The invention disclosed herein relates to a packaging material, particularly a cellular cushioning article having an arrangement of inflated cells projecting from a major surface of the article.

BACKGROUND

Cellular cushioning articles are used for packaging, for example, for wrapping items needing protection when mailing, shipping or stored in a container, on a shelf, etc. One type of cellular cushioning article comprises a polymeric backing and a top layer partially in contact with the backing such that a layer of discrete hemispherical bubbles are formed across a major surface of the article. A cellular cushioning article of this type is known as Bubble Wrap® manufactured by Sealed Air Corp. Cellular cushioning articles comprising layers of discrete hemispherical bubbles are available in different configurations with respect to the diameters and heights of the bubbles, and generally provide more cushioning as bubble size increases.

SUMMARY

A cellular cushioning article is disclosed herein, the article comprising a polymeric film comprising first cells projecting from a major surface of the polymeric film, each first cell being surrounded by land area, wherein the first cells are arranged in rows substantially parallel to each other and substantially parallel to a length of the polymeric film, such that for two opposing polymeric films with the major surfaces facing each other, the total thickness of the two opposing polymeric films is less than twice the thickness of one polymeric film. The first cells may have any shape, for example, the first cells may be substantially hemispherical and have substantially the same diameter.

In some embodiments, the cellular cushioning article further comprises second cells projecting from the major surface and interspersed with the first cells in the rows comprising the first cells, wherein the second cells are substantially hemispherical and have substantially the same diameter, the diameter of the second cells being less than that of the first. Anywhere from a single second cell to as many as ten second cells may be disposed between adjacent first cells.

The cellular cushioning article may further comprise a plurality of fold zones comprising land area and being free of first cells. The fold zones extend across a width of the polymeric film, and are disposed between groups of the first cells. The cellular cushioning article may comprise two edge zones, each edge zone extending along an edge of the polymeric film and having a width of about two inches or less, the edge zones comprising land area and being free of first cells. The fold and/or edge zones may comprise second cells.

In general, the cellular cushioning article may be perforated across the width of the film. The cellular cushion article can be fan-folded to form a stack, and the stack can be disposed in a box or a bag. Stacks formed by fan-folding the cellular cushioning article disclosed herein can occupy much less volume as compared to stacks formed by fan-folding known cellular cushioning articles.

These and other aspects of the invention are described in the detailed description below. In no event should the above summary be construed as a limitation on the claimed subject matter.

BRIEF DESCRIPTION OF DRAWINGS

The invention is further explained with reference to the following drawings which are intended to be merely illustrative and not limiting. The drawings are not necessarily to scale.

DETAILED DESCRIPTION

Figure 1:
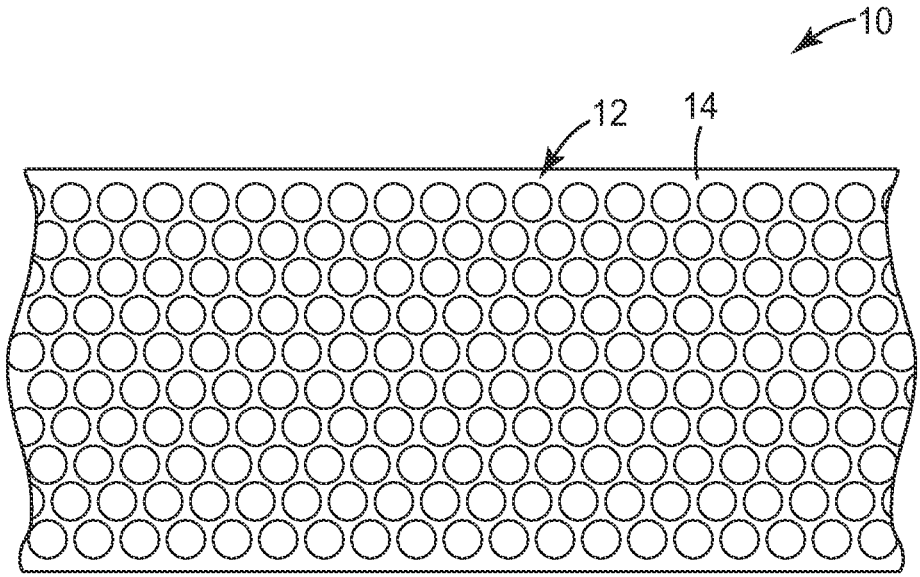
FIG. 1 Prior Art
FIG. 1 shows a plan view of a known cellular cushioning article.

Cellular cushioning articles have been known for many years, and many different types are available. One type of cellular cushioning article is illustrated in plan view in FIG. 1 and comprises polymeric film 10 having hemispherical cells 12, that protrude from a major surface of the film. Each cell is surrounded by land area 14. The cells are arranged in a tight hexagonal configuration with little land area between the cells, relative to the diameter of the cells. For example, Bubble Wrap® is available with cells having a 3 cm diameter and less than 4 mm of land area between cells. These types of known cellular cushioning articles perform well, however, large quantities are extremely bulky to store when not in use.

Figure 2:
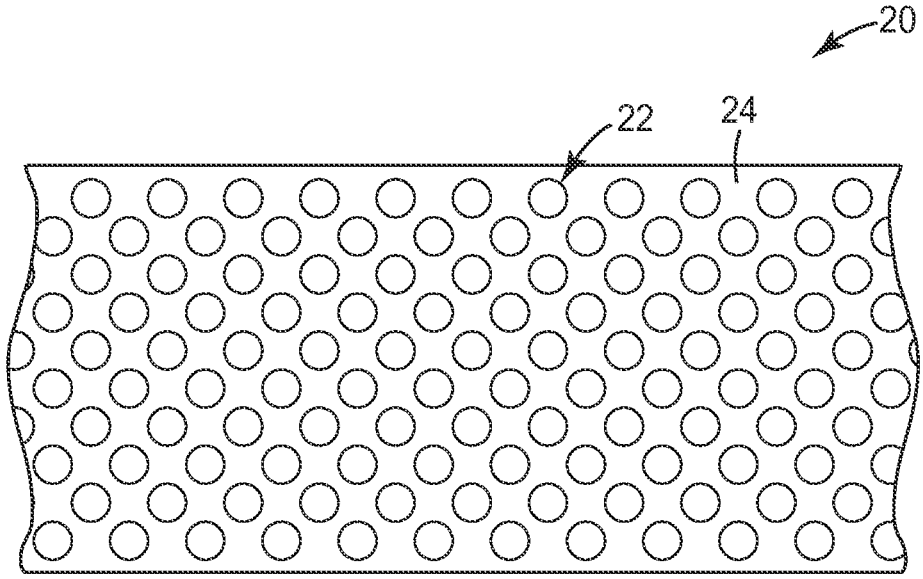
FIG. 2 shows a plan view of an exemplary cellular cushioning article disclosed herein.
Figure 3A:
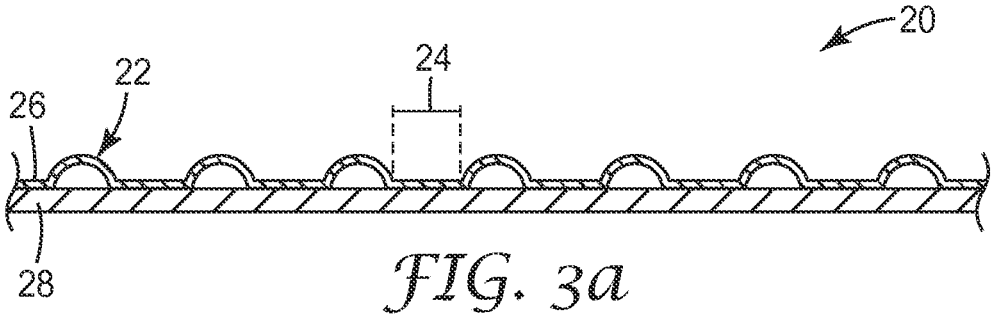
FIG. 3*a* shows a cross-sectional view of the exemplary cellular cushioning article shown in FIG. 2.

FIG. 2 shows a plan view of an exemplary cellular cushioning article disclosed herein. Cellular cushioning article 20 comprises a polymeric film having a major surface, and first cells 22 protrude from the surface, each cell being surrounded by land area 24. First cells 22 are arranged in rows substantially parallel to each other and substantially parallel to a length of the polymeric film. In this particular example, the cells are hemispherically shaped and have substantially the same diameter. FIG. 3*a* shows a cross-sectional view of exemplary cellular cushioning article 20. Top layer 26 is disposed on bottom layer 28 such that first cells 22 are formed between the layers. First cells 22 are discreet, substantially hemispherical cells having substantially the same diameter, and the cells are surrounded by land area 24. The diameter of first cells 22 may be from about 0.20 to about 3 inches, preferably from about 1 to about 1.5. The land area between the first cells may be any distance relative to the diameter of the first cells, as long as the first cells nest as desired. Preferably, the diameter of first cells 22 may be from about 1 to about 1.5 inches with a land area between the first cells being from about 0.8 to about 2.5 inches.

It is to be understood that the cellular cushioning article disclosed herein may be formed in many different ways, and thus, the invention is not limited to articles constructed as shown in FIG. 3*a*. For example, the cellular cushioning article may comprise more than two layers, or the cells may not be formed from a layer of material.

Figure 8:
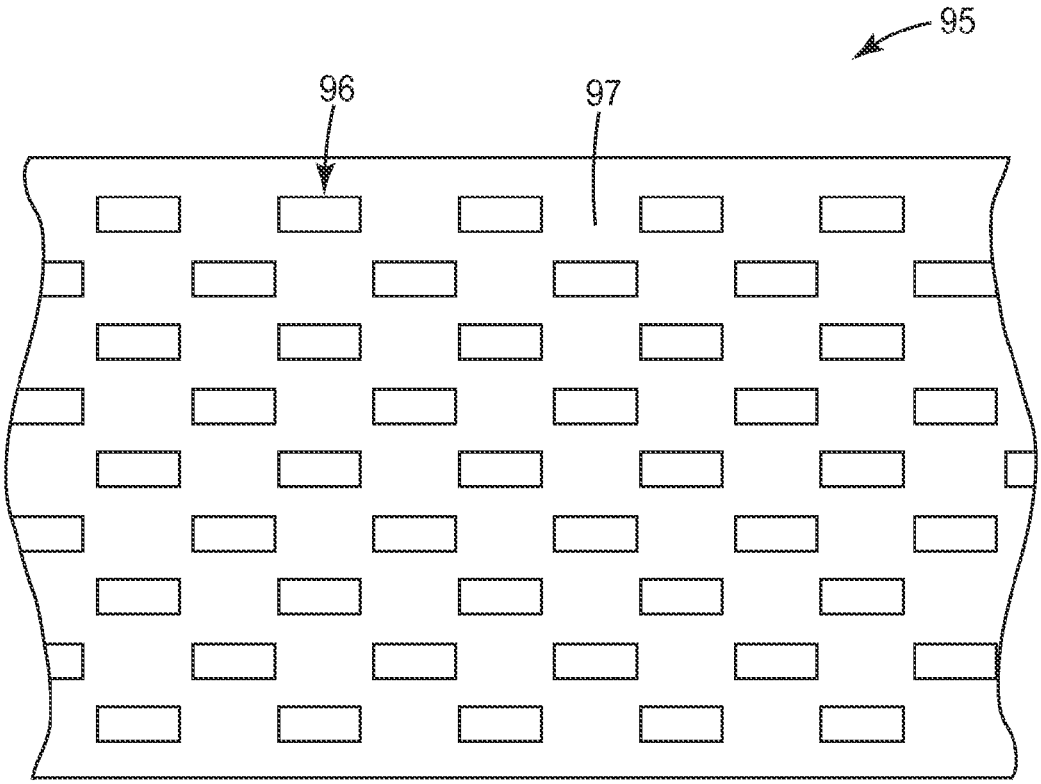

Further, although first cells 22 are substantially hemispherical and have substantially the same diameter, the shapes and sizes of the first cells may be any shape or size, or combination of shapes and sizes, as long as two of the same articles can nest with each other. For example, the first cells may have hemispherical, oval, square, rectangular, triangular, hexagonal, polygonal or star shapes. For example, FIG. 8 shows a plan view of an exemplary cellular cushioning article 95 comprising a polymeric film having a major surface, and first cells 96 protrude from the major surface, each cell being surrounded by land area 97. First cells 96 have a rectangular shape and are arranged in rows substantially parallel to each other and substantially parallel to a length of the polymeric film.

In general, the cellular cushioning article of the invention can be characterized by the way in which the cells are arranged on a major surface of a polymeric film, in combination with the shapes and sizes of the cells. For two of the same cellular cushioning articles placed on top of one another, with the cells of each article facing each other, the cells "nest" with each other. Because of this nesting feature, the total thickness of the two nested articles can be less than the sum of the thicknesses for the two articles.

Figure 3B:
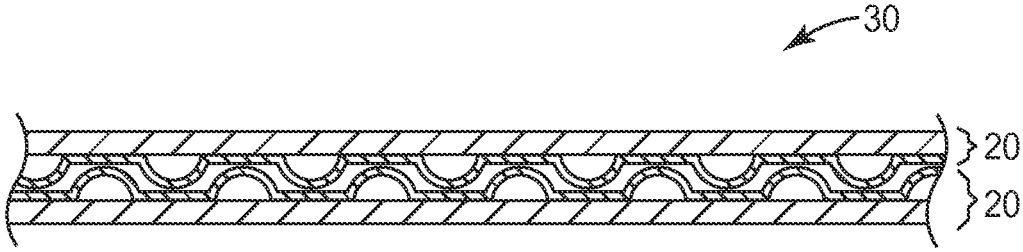
FIG. 3*b* shows a cross-sectional view of two exemplary cellular cushioning articles shown in FIG. 3*a*, wherein the two articles are stacked such that inflated cells of each article face each other.
Figure 3C:
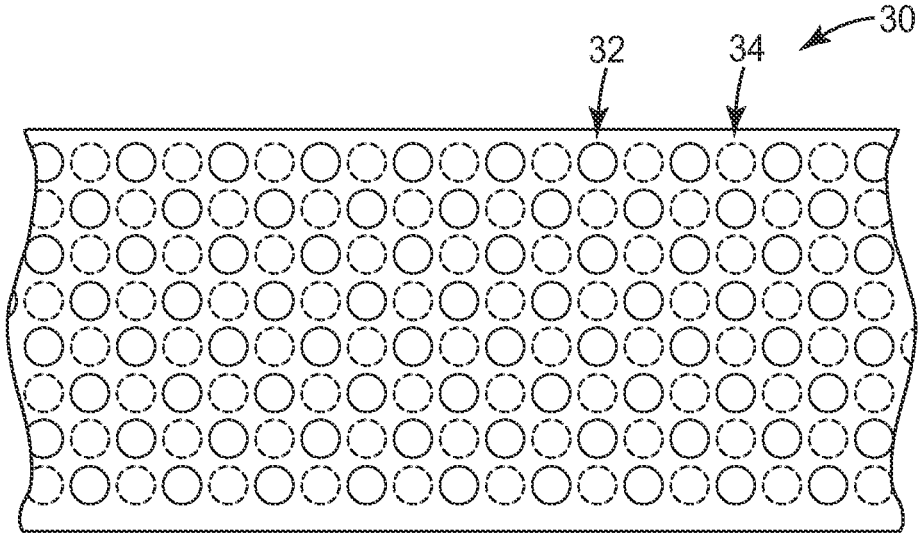
FIG. 3*c* shows a plan view of the two exemplary cellular cushioning articles shown in FIG. 3*b*.

FIG. 3*b* shows a cross-sectional view of two exemplary cushioning articles 20 that are nested with each other to form stacked article 30. FIG. 3*c* shows the corresponding plan view of stacked article 30, with cells 32 drawn in solid lines belonging to one of the articles 20, and cells 34 drawn in dashed lines belonging to the other.

Figure 4A:
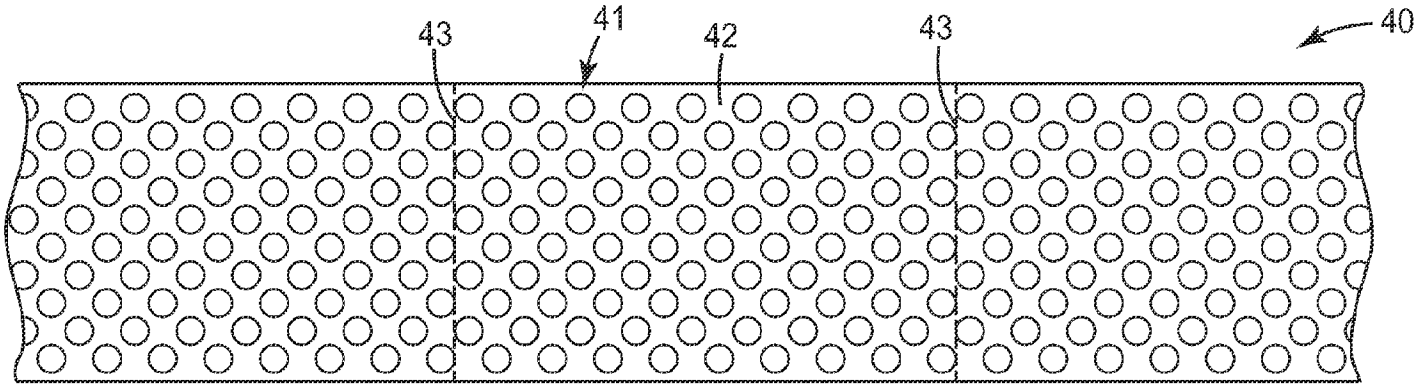
FIGS. 4*a*-4*b*, 5*a*-5*b*, 6*a*-6*c*, 7*a*-7*c* and 8 show plan views of exemplary cellular cushioning articles disclosed herein.

The cellular cushioning article of the invention may be perforated such that a long sheet of the article can be separated into shorter sheets. FIG. 4*a* shows a plan view of exemplary cellular cushioning article 40 comprising first cells 41 protruding from a major surface of a polymeric film, each cell being surrounded by land area 42. Article 40 is perforated across a width of the polymeric film as indicated by dashed lines 43.

Figure 4B:
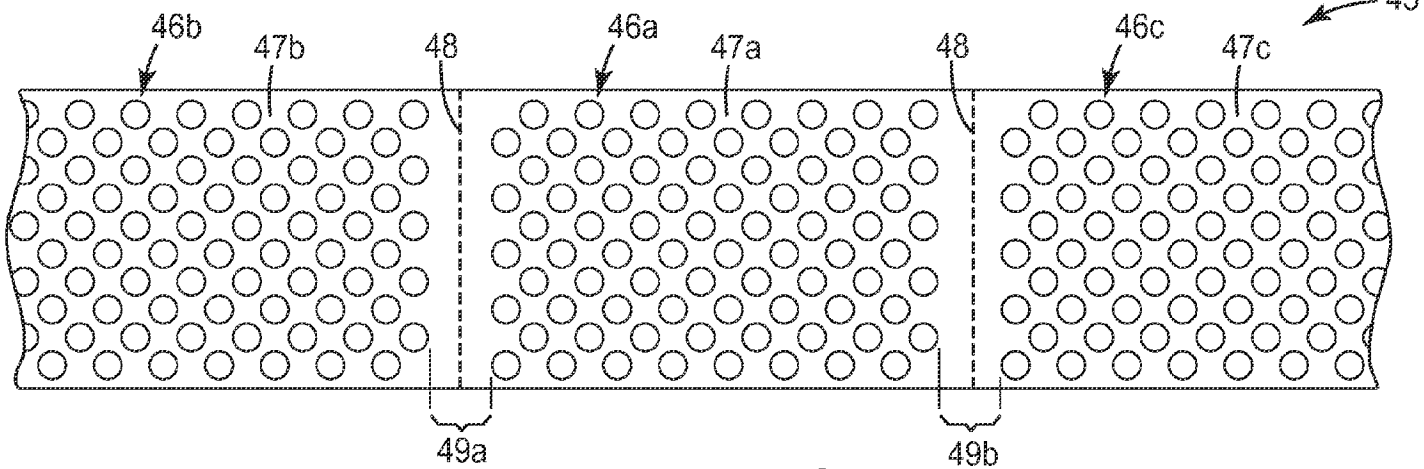

The first cells are generally arranged in a pattern, and the pattern may include periodic, repeating groups of cells as shown in FIG. 4*b*. FIG. 4*b* shows a plan view of exemplary cushioning 45 comprising three groups of first cells 46*a-c* with corresponding land areas 47*a-c*. Cellular cushioning article 45 comprises fold zones 49*a-b* each comprising a width of land area determined by measuring the distance between the first cells as shown in FIG. 4*b* (the distance is measured substantially parallel to the rows). Fold zones 49*a-b* are free of first cells 46*a-c*. In general, fold zones may be from about 0.15 to about 4.0 inches along the length of the polymeric film, and the fold zones may extend across a width of the polymeric film as shown in FIG. 4*b*. In general, fold zones separate first cells into groups. First cells 46*a-c* are arranged in groups that are substantially identical to each other. Cellular cushioning article 45 is perforated within the fold zones, across the width of the polymeric film, as shown by dashed lines 48.

Figure 5A:
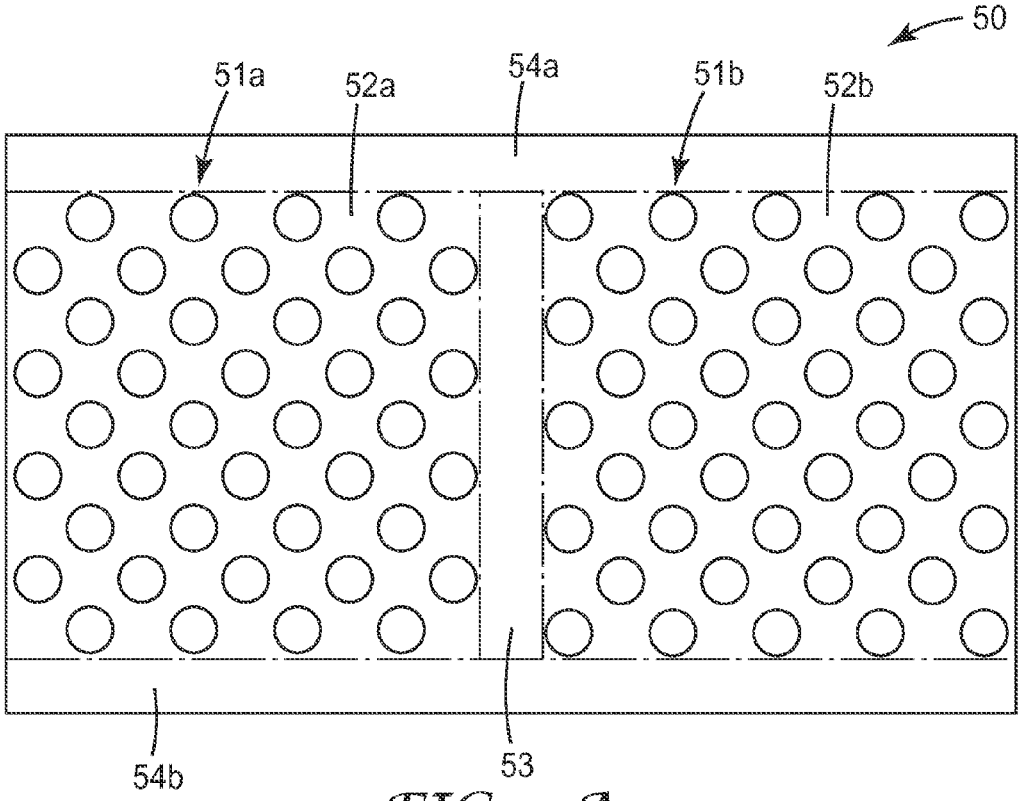
Figure 5B:
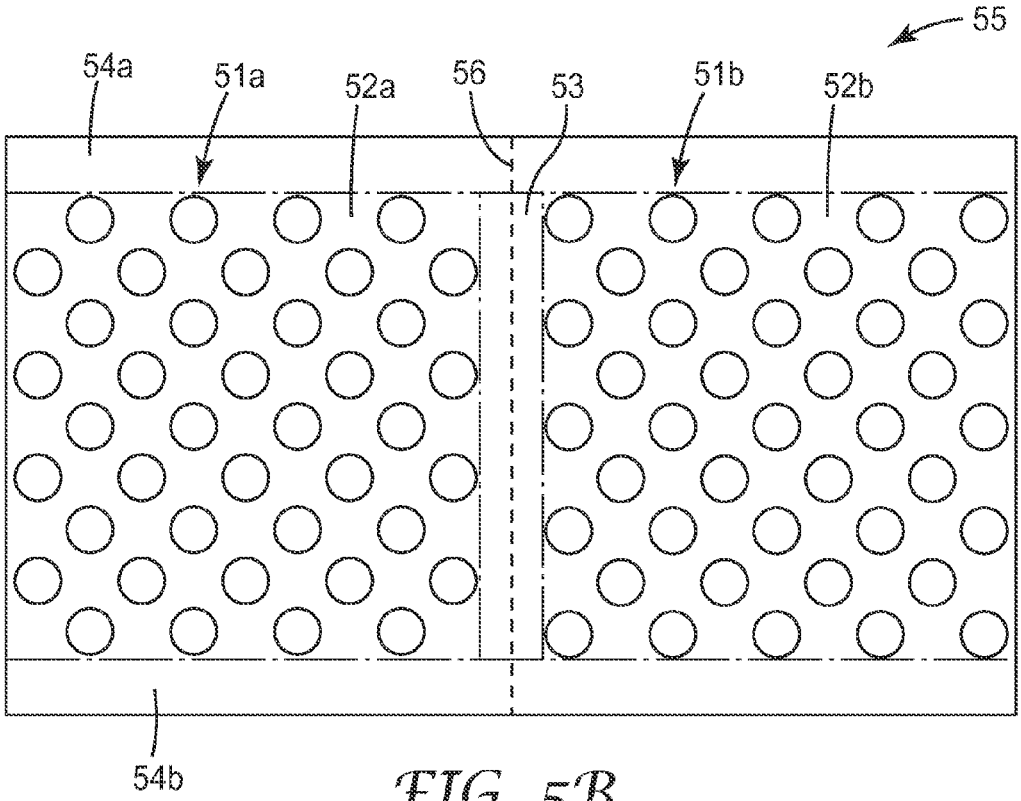

FIG. 5*a* shows a plan view of exemplary cushioning article 50 comprising first cells 51*a-b* arranged in identical groups (only portions of the groups are shown), with the first cells surrounded by land area 52*a-b*. Fold zone 53 separates the groups of first cells. In this embodiment, cellular cushioning article has two edge zones 54*a-b* at each edge of the polymeric film. Fold zone 53 and edge zones 54*a-b* are free of first cells 52*a-b*. FIG. 5*b* shows a plan view of exemplary cushioning article 55 comprising cellular cushioning article 50 that is perforated across the width of the polymeric film as indicated by dashed line 56. In general, edge zones have a width of about 1 inch or less.

Figure 6A:
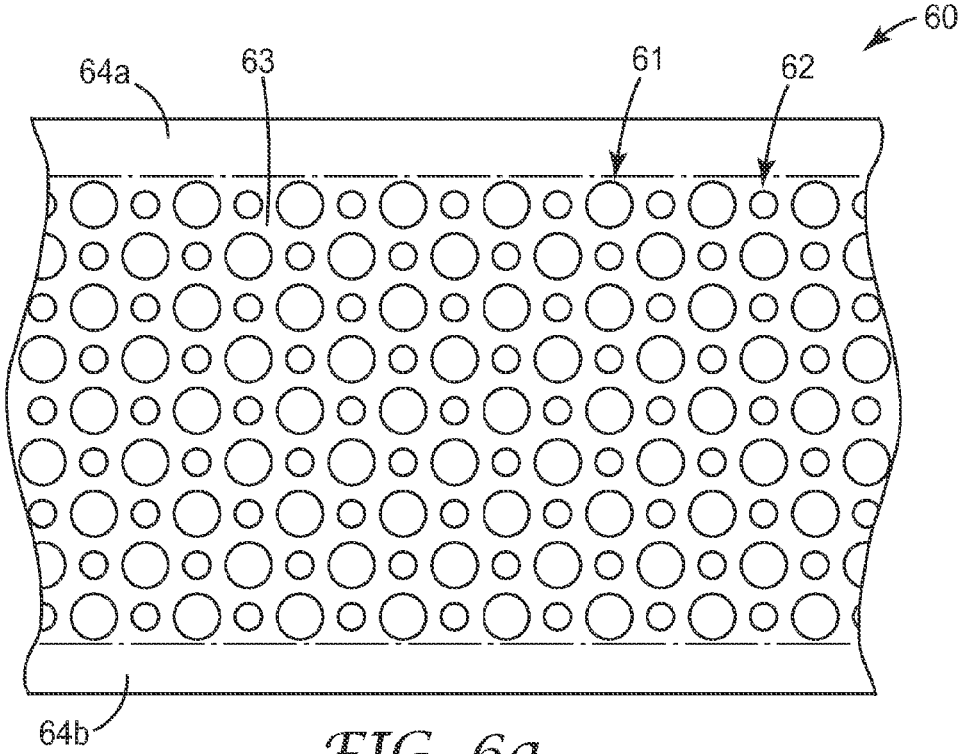

The cellular cushioning article may comprise more than one type of cell projecting from the major surface of the polymeric film. FIG. 6*a* shows a plan view of exemplary cushioning article 60 comprising first cells 61 and second cells 62. Both first and second cells have substantially hemispherical shapes. The first cells have substantially the same diameter, and the second cells have substantially the same diameter, and the diameter of the second cells is less than that of the first. Second cells 62 are interspersed with first cells 61 in the rows comprising the first cells. Land area 63 is between the first and second cells. Cellular cushioning article 60 also comprises edge zones 64*a-b*.

Figure 6B:
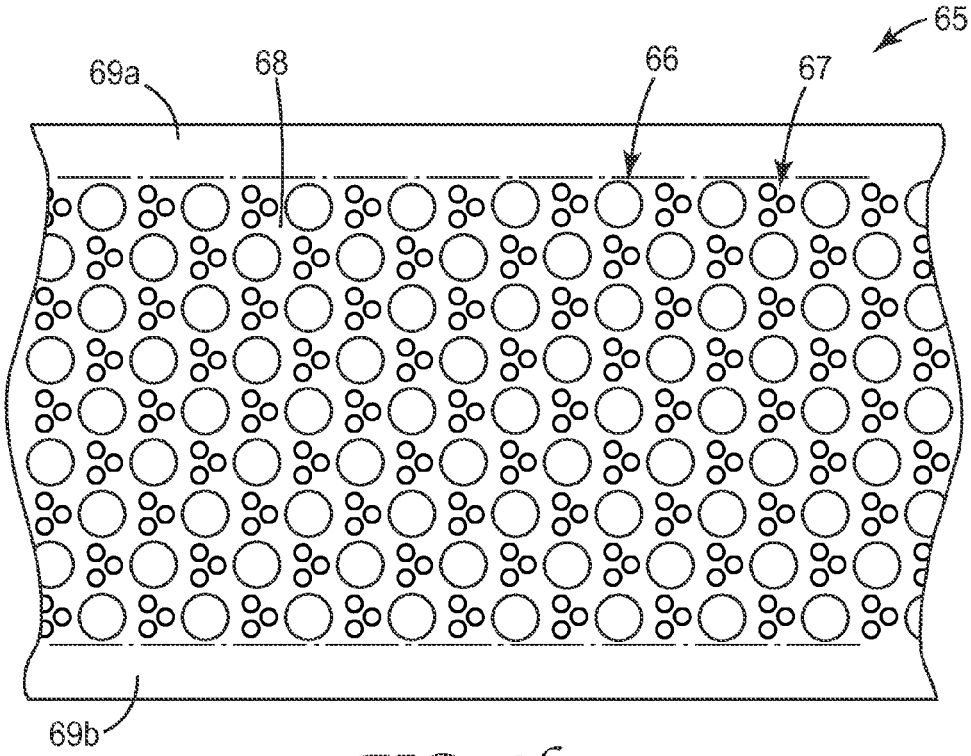

Anywhere from 1 to 10 cells smaller than the first cells may be grouped together to form second cells. Preferably, there are 3, 5 or 7 cells grouped together to form second cells. FIG. 6*b* shows an embodiment in which cellular cushioning article 65 comprises first cells 66 and three small cells form second cells 67. Land area 68 is between the first and second cells. Cellular cushioning article 65 also comprises edge zones 69*a-b*.

Figure 6C:
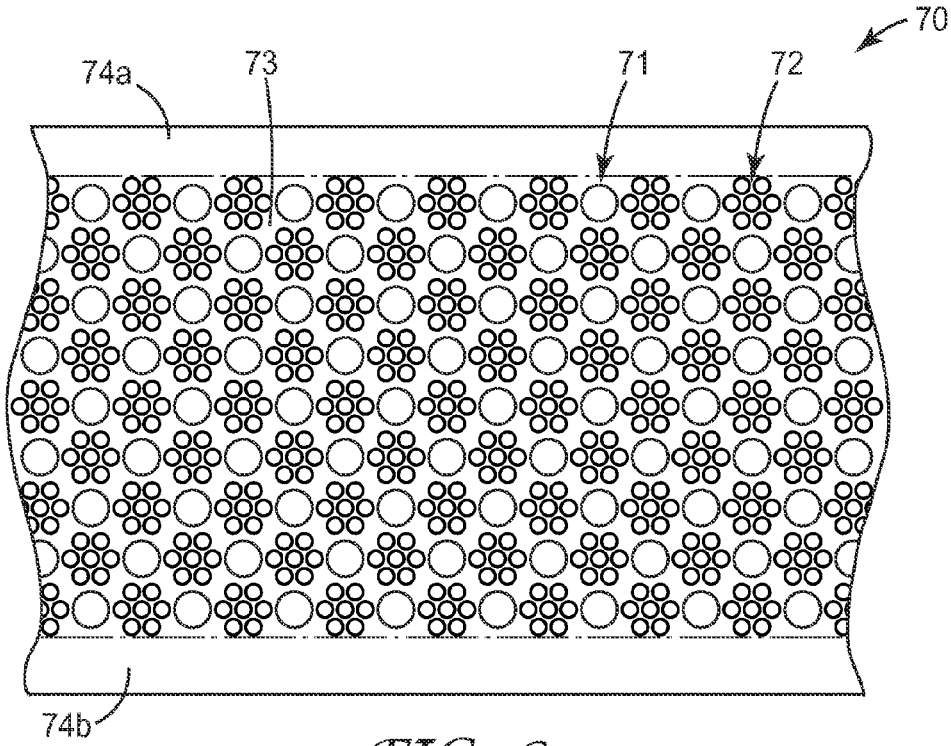

FIG. 6*c* shows an embodiment in which cellular cushioning article 70 comprises first cells 71 and seven small cells form second cells 72. Land area 73 is between the first and second cells. Cellular cushioning article 70 also comprises edge zones 74*a-b*.

The cellular cushioning article may comprise a nestable pattern in which the second cells have the same diameter as the first cells, but have less height relative to the first cells.

Figure 7A:
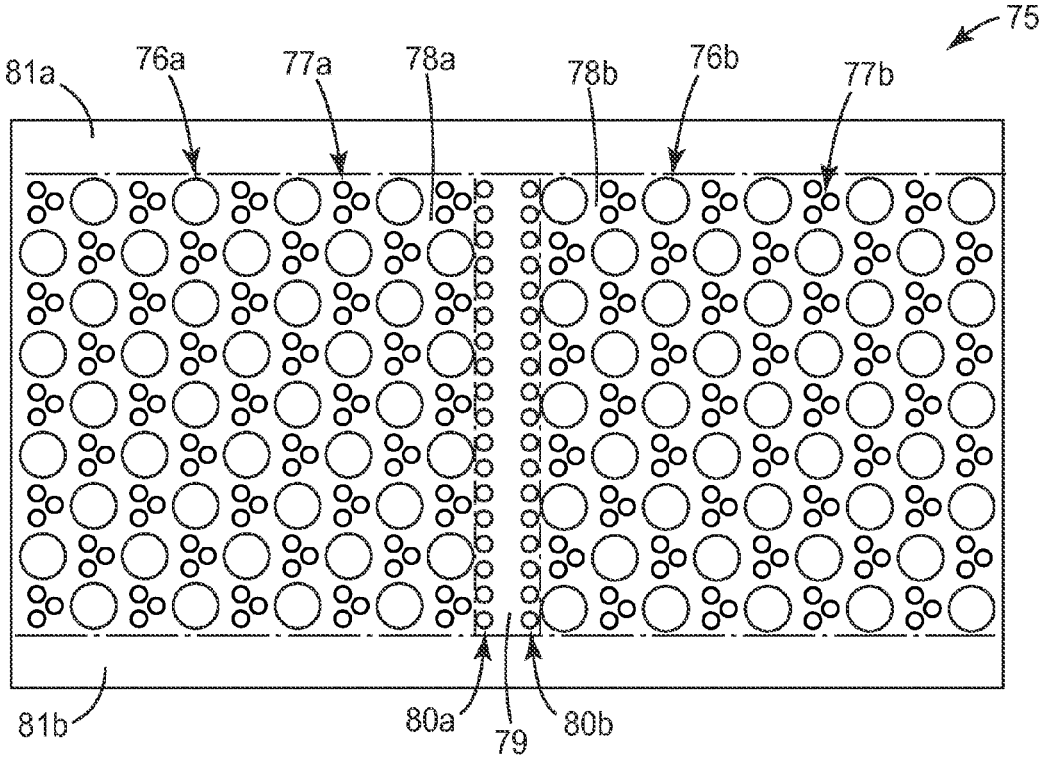
Figure 7B:
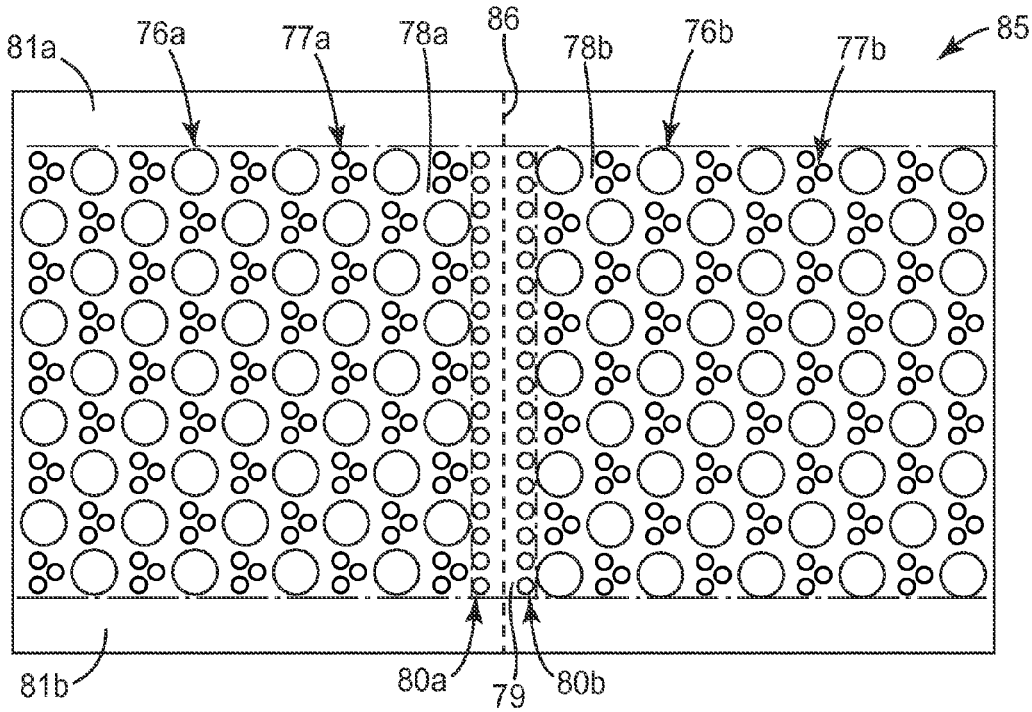

FIG. 7*a* is a plan view of another embodiment of the cellular cushioning article disclosed herein. Cellular cushioning article 75 comprises first cells 76*a-b* and second cells 77*a-b* interspersed with the first cells as shown. The first and second cells are arranged in identical groups (only portions of the groups are shown), with the first and second cells surrounded by land area 78*a-b*. Fold zone 79 separates the groups of first and second cells. In this embodiment, cellular cushioning article has two edge zones 81*a-b* at each edge of the polymeric film. Fold zone 79 and edge zones 81*a-b* are free of first cells 76*a-b*. In this embodiment, fold zone 79 comprises third cells arranged in columns 80*a-b*. The third cells may or may not be the same as the cells that form the second cells 77*a-b*. FIG. 7*b* shows a plan view of exemplary cushioning article 85 comprising cellular cushioning article 75 that is perforated across the width of the polymeric film as indicated by dashed line 86.

Figure 7C:
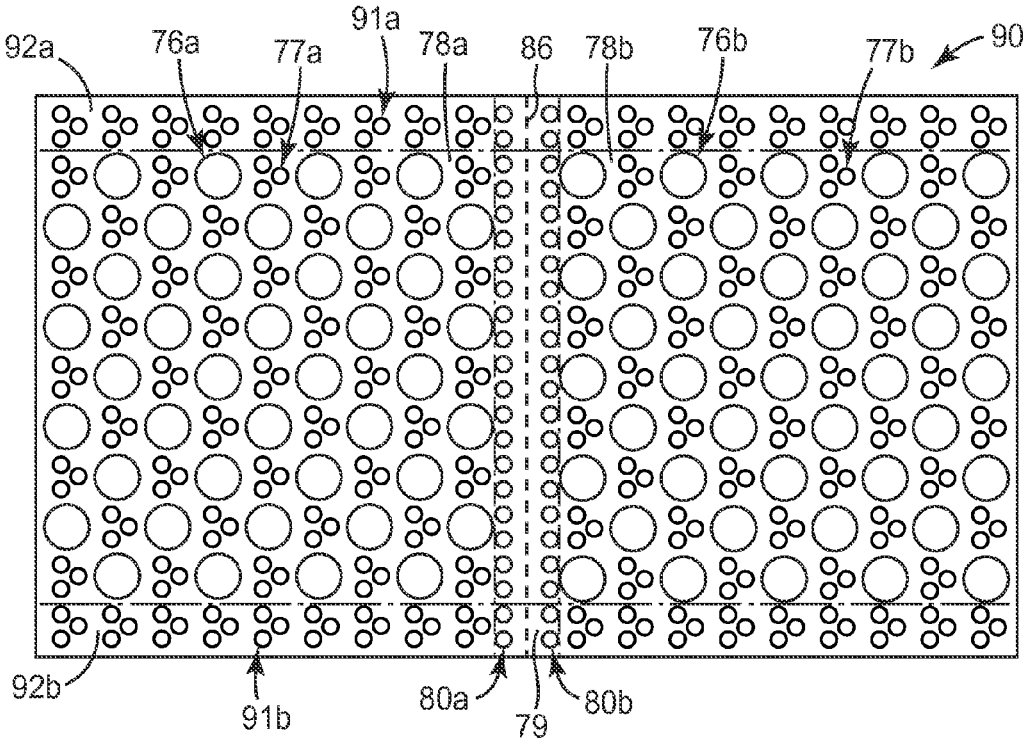

The cellular cushioning article disclosed herein may comprise fourth cells disposed in rows in edge zones. FIG. 7*c* shows a plan view of exemplary cushioning article 90 comprising cellular cushioning article 85 having rows of fourth cells 91*a-b* arranged in edge zones 81*a-b*, respectively. The fourth cells may or may not be the same as the cells that form the second cells 77*a-b* or the third cells in columns 80*a-b*.

The embodiment shown in FIG. 7*c* can be described as follows: A cellular cushioning article comprising: a polymeric film comprising first cells projecting from a major surface of the polymeric film, each first cell being surrounded by land area, wherein the first cells are arranged in rows substantially parallel to each other and substantially parallel to a length of the polymeric film, such that for two opposing polymeric films with the major surfaces facing each other, the total thickness of the two opposing polymeric films is less than twice the thickness of one polymeric film; a plurality of fold zones comprising land area and being free of first cells, the fold zones being from about 0.15 to about 4.0 inches along the length of the polymeric film and extending across a width of the polymeric film, wherein the first cells are arranged in groups substantially identical to each other and separated from each other by a fold zone; two edge zones, each edge zone extending along an edge of the polymeric film and having a width of about 2 inches or less, the edge zones comprising land area and being free of first cells; and second cells projecting from the major surface, wherein the second cells are substantially hemispherical and have substantially the same diameter, the diameter of the second cells being less than that of the first, wherein the second cells are arranged in columns in the fold zones and rows in the edge zones, and the polymeric film is perforated in the fold zones across the width of the polymeric film.

Figure 9:
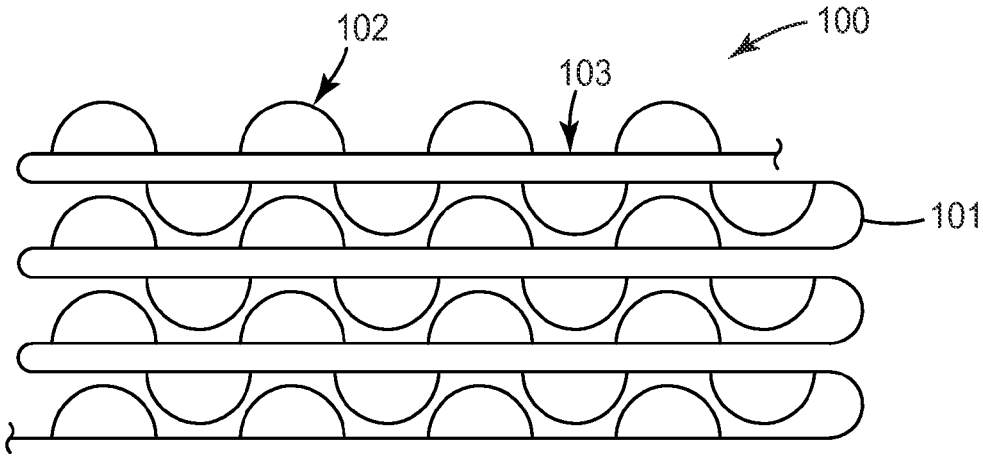
FIG. 9 shows a cross-sectional view of a fan-folded cellular cushioning article.

The cellular cushioning article disclosed herein may be fan-folded into a stack with the major surfaces facing each other, and the stack is disposed in a box or a bag. FIG. 9 is a cross-sectional view of cellular cushioning article 101 fan-folded to form stack 100. The cellular cushioning article comprises first cells 102 with land area 103.

EXAMPLES

A cushion wrap article or roll with a plurality of multi-size bubbles for cushioning, wherein the bubbles are arranged in a pattern to provide reduced volume when folded. The lower bubbles nest with the larger bubbles when folded. A fan-folded option and a machine direction fold option are described. An improved bubble pattern for edge and perforation zones to reduce loss of cushioning at the edges is described.

This example illustrates an exemplary cellular cushioning article fan-folded into a stack wherein the volume of the stack is at least 30% less than that of a stack formed from a standard cellular cushioning article. A standard 25 foot roll of ½" size bubble cushion wrap (FIG. 1 with first cells having a height of about ½ inch) was modified to allow nesting when fan-folded. The nesting pattern was achieved by deflating a bubble pattern in each sheet that allowed nesting when folded face to face. The cushion wrap was fan folded nesting the deflated bubble pattern with the inflated bubble pattern on the opposite sheet. The resulting fan-folded stacked sheets occupied significantly less space then a standard 25 foot roll of ½" bubble cushion wrap. The height of the fan-folded stack was 6½" for the nestable pattern vs. 10½" for the standard ½" bubble cushion wrap. The nestable fan-folded sample had 38% less volume than the standard ½" bubble fan-folded.

A 100 foot roll of standard 3⁄16" bubble cushion wrap was fan-folded and placed in a box (12½"×12½"×12½"). Currently a standard 100 foot roll of 3⁄16" cushion wrap is sold in a boxed configuration (roll placed inside a 15"×12⅜"×13½" box). The fan-folded cushion wrap in a box is ~22% smaller than the current roll in a box.

Several box designs were evaluated for dispensing performance of the fan-folded cushion wrap. A larger slot width performed better for the larger ½" size bubble. This allows the folded sheet to more easily be pulled out when the box is full.

The smaller 3⁄16" bubble was also evaluated for dispensability in a 2' and 8" width slot. Both slot widths dispensed the smaller bubble size although the 8" width was preferred when the box was full.

A length of standard ½" size Bubble Wrap® (from Sealed Air Corp.) was also modified to allow nesting, when folded length-wise, with the bubbles facing each other. The nesting pattern was achieved by deflating bubbles. The folded length of nested cushioning article was rolled up. The resulting folded roll was significantly smaller than the same length roll of standard ½" cushion wrap.

Improved edge and perforation protection is illustrated by the following example. Current cushion wrap, in particular larger size bubbles such as ½" bubble, damages or deflates bubbles with the perforation and slitting process. The perforation process currently deflates approximately 1 row every 11 rows of bubbles for ½" bubble cushion wrap. In addition, the slitting process to convert wide master rolls to a 12" width roll will deflate approximately ½ to 1 row of bubbles on each side. A further improvement to the cushion wrap would incorporate a unique bubble pattern to minimize the amount of deflated bubbles that currently occur during the perforation and slitting process by including a smaller size bubble pattern at the perforation and slitting locations. An example of this bubble pattern is in FIG. 7*c*.

What is claimed is:

1. A cellular cushioning article comprising:

a polymeric film comprising, first cells projecting from a major surface of the polymeric film, each first cell being surrounded by land area, wherein the first cells are arranged in rows substantially parallel to each other and substantially parallel to a length of the polymeric film, such that for two opposing polymeric films with the major surfaces facing each other, the total thickness of the two opposing polymeric films is less than twice the thickness of one polymeric film, two edge zones, each edge zone extending along an edge of the polymeric film, the edge zones comprising land area and being free of first cells; and second cells projecting from the major surface and arranged in rows within the edge zones, wherein the second cells are substantially hemispherical and have substantially the same diameter, the diameter of the second cells being less than that of the first.

2. The cellular cushioning article of claim 1, wherein the first cells are substantially hemispherical and have substantially the same diameter.

3. The cellular cushioning article of claim 1, the article further comprising second cells projecting from the major surface and interspersed with the first cells in the rows comprising the first cells, wherein the second cells are substantially hemispherical and have substantially the same diameter, the diameter of the second cells being less than that of the first.

4. The cellular cushioning article of claim 1, the article further comprising second cells projecting from the major surface and interspersed with the first cells in the rows comprising the first cells, wherein each second cell comprises from 1 to 10 cells having a diameter less than that of the first cell.

5. The cellular cushioning article of claim 1, the article further comprising second cells projecting from the major surface and interspersed with the first cells in the rows comprising the first cells, wherein each second cell comprises three, five or seven cells having a diameter less than that of the first cell.

6. The cellular cushioning article of claim 1, wherein the first cells have hemispherical, oval, square, rectangular, triangular, hexagonal, polygonal or star shapes.

7. The cellular cushioning article of claim 2, wherein the diameter is from about 0.20 to about 3 inches.

8. The cellular cushioning article of claim 2, wherein the diameter is from about 1 to about 1.5 inches, and the land area between the first cells is from about 0.8 to about 2.5 inches.

9. The cellular cushioning article of claim 1, wherein the polymeric film is perforated across a width of the film.

10. The cellular cushioning article of claim 1, further comprising a plurality of fold zones comprising land area and being free of first cells, each fold zone being from about 0.15 to about 4.0 inches along the length of the polymeric film and extending across a width of the polymeric film, wherein the first cells are arranged in substantially identical groups, and the groups are separated by the fold zones.

11. The cellular cushioning article of claim 10, wherein the polymeric film is perforated in the fold zones across the width of the polymeric film.

12. The cellular cushioning article of claim 10, further comprising second cells projecting from the major surface and arranged in columns within the fold zones, wherein the second cells are substantially hemispherical and have substantially the same diameter, the diameter of the second cells being less than that of the first.

13. The cellular cushioning article of claim 1, wherein each edge zone has a width of about 1 inch or less.

14. The cellular cushioning article of claim 1, wherein each edge zone has a width of about 2 inches or less.

15. The cellular cushioning article of claim 1, further comprising:

a plurality of fold zones comprising land area and being free of first cells, each fold zones being from about 0.15 to about 4.0 inches along the length of the polymeric film and extending across a width of the polymeric film, wherein the first cells are arranged in substantially identical groups, and the groups are separated by the fold zones;

wherein each edge zone has a width of about 2 inches or less; and wherein the second cells are arranged in columns in the fold zones, and the polymeric film is perforated in the fold zones across the width of the polymeric film.

16. The cellular cushioning article of claim 1, wherein the article is fan-folded to form a stack, and the stack is disposed in a box or a bag.

* * * * *